US006681879B2

(12) United States Patent
Iannarelli et al.

(10) Patent No.: US 6,681,879 B2
(45) Date of Patent: Jan. 27, 2004

(54) MUFFLER EXHAUST STACK

(75) Inventors: Philip A. Iannarelli, Burlington, IA (US); John Kinney, Burlington, IA (US); Rodney S. Park, Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/961,730

(22) Filed: Sep. 24, 2001

(65) Prior Publication Data

US 2002/0084133 A1 Jul. 4, 2002

Related U.S. Application Data

(60) Provisional application No. 60/258,960, filed on Dec. 29, 2000.

(51) Int. Cl.[7] ..... B60K 13/04

(52) U.S. Cl. ..... 180/309

(58) Field of Search ..... 180/309; 285/332, 285/332.1, 328, 7; 280/782; 293/113

(56) References Cited

U.S. PATENT DOCUMENTS

| | | | | | |
|---|---|---|---|---|---|
| 755,325 | A | * | 3/1904 | Soutar | 285/332 |
| 794,110 | A | * | 4/1905 | McDowell | 285/332.1 |
| 1,365,730 | A | * | 1/1921 | Sager | 285/332.1 |
| 2,246,891 | A | * | 6/1941 | Moise | 285/332 |
| 2,660,457 | A | * | 11/1953 | Mallon | 285/7 |
| 3,244,437 | A | * | 4/1966 | Belicka et al. | 285/7 |
| 3,390,897 | A | * | 7/1968 | Moore | 285/332 |
| 3,401,774 | A | * | 9/1968 | Krahn | 180/309 |
| 4,378,945 | A | * | 4/1983 | Trautman | 180/309 |
| 4,537,280 | A | * | 8/1985 | Roberts | 180/309 |
| 4,897,068 | A | * | 1/1990 | Jackson | 180/309 |
| 5,253,520 | A | * | 10/1993 | Drexel et al. | 285/332 |
| 5,988,308 | A | * | 11/1999 | Qutub | 180/309 |

FOREIGN PATENT DOCUMENTS

| | | | | |
|---|---|---|---|---|
| CA | 2043184 | * | 9/1992 | 180/309 |
| DE | 2802112 | * | 7/1979 | 180/309 |

* cited by examiner

*Primary Examiner*—Frank Vanaman
(74) *Attorney, Agent, or Firm*—John William Stader; Rebecca L. Henkel

(57) ABSTRACT

An exhaust stack system for a muffler having an exhaust stub pipe including a self-holding taper on the outer diameter of the exhaust stub pipe. The exhaust stack pipe also has a self-holding taper on the inner diameter of the proximal end so as to matingly connect to the taper on the exhaust stub pipe. Preferably a securing mechanism holds the exhaust stack pipe in proper orientation with the muffler stub pipe. In a preferred embodiment, the securing mechanism further includes a spring clip member. The exhaust stack pipe has a longitudinal slot approximate the taper and the muffler stub pipe has a hole in alignment with the longitudinal slot so that a hooked end of the spring clip can fit through the longitudinal slot and into the hole. In another embodiment, the securing mechanism is a screw through the exhaust stack pipe and the muffler stub pipe.

3 Claims, 3 Drawing Sheets

MUFFLER EXHAUST STACK

This application claims the benefit of Provisional application Ser. No. 60/258,960, filed Dec. 29, 2000.

FIELD OF THE INVENTION

The present invention relates to exhaust stack pipe systems used to remove exhaust fumes from the muffler of an engine and in particular to vertical exhaust stack pipes and connections for use in agricultural or construction vehicles.

BACKGROUND OF THE INVENTION

The exhaust systems of agricultural and construction vehicles include mufflers to reduce noise and emissions. The exhaust system also includes exhaust pipes to remove exhaust fumes away from the vehicle operator. For front engine vehicles, the exhaust system is typically located in the front of the vehicle. For most agricultural or construction vehicle having front engines, the exhaust system usually can not be routed to the rear of the vehicle because work attachments and other implements are often located at the rear of the vehicle. For rear engine agricultural and construction vehicles, the exhaust system usually exits above or on the side of the engine compartment rather than from the back or bottom of the engine. Thus, for an agricultural or construction vehicle it is common for a vertical exhaust stack system to be located on the top or the side of the front hood or on the top or the side of the rear engine compartment.

The muffler for the vehicle is often positioned in a horizontal or vertical orientation along the side or the top of the engine. The exhaust stack pipe extends vertically upward from the exhaust outlet stub pipe of the muffler to emit exhaust from the engine at a sufficient distance above and away from the operator or cab of the vehicle. The exhaust fumes will be dissipated quickly without being drawn into the cab, for example.

It is necessary to locate such vertically oriented exhaust stack pipes in front of or on the side of the operator or cab for front engine vehicles for various reasons previously mentioned. For example, the exhaust system can not be located under an agricultural or construction vehicle due to the need for high ground clearance and because of the possible damage resulting from unintended ground contact.

In one currently used exhaust stack system, an exhaust stack pipe is merely clamped to the vertical exhaust outlet stub pipe of the muffler with a compression-type clamp. Because the muffler usually vibrates with the engine, the compression clamp causes considerable undesirable stress concentrations on the exhaust stack pipe at the clamp line. As a result, the exhaust stack pipe is subject to fatigue and premature failure. For example, some exhaust stack pipes have prematurely failed after only a couple of hundred hours of operation. Replacing and maintaining exhaust stack systems is expensive and may also result in vehicle down time due to delays to obtain replacement parts.

As shown in FIG. 1, one currently used, vertically orientated exhaust stack pipe 12 has longitudinal slits 14 at the proximal end 18. The slits allow the proximal end of the exhaust stack pipe to be flared outward. The flared portion 16 of the exhaust stack pipe can then fit over the exhaust outlet stub pipe 20. The exhaust outlet stub pipe 20 is vertically orientated from the muffler 22, and is generally only a short pipe, about 2 or 3 inches long. The exhaust outlet stub pipe 20 usually has a constant diameter that is smaller than the flared portion 16 of the exhaust stack pipe 12. A compression clamp 24, such as a U-clamp or a ring clamp, secures the flared portion 16 of the exhaust stack pipe to the exhaust stub pipe 20 of the muffler. The clamp 24 is tightened around the flared portion 16 to provide a sealed passageway between the muffler 22 and the exhaust pipe 12 and also to mechanically hold the exhaust stack pipe 12 in a vertical position on the muffler stub pipe 20.

Unfortunately, a tight compression clamp can create stress concentrations such as hoop stress on the exhaust stack pipe. The resulting stress can lead to premature failure at the proximal end 16 of the exhaust stack pipe 12, which is already weakened by being slit and flared outward. Loosening the compression clamp 24 may reduce the hoop stress but is not a solution since a loose clamp allows exhaust fumes to leak from the exhaust outlet stub pipe. Alternatively a loose clamp may allow the exhaust stack pipe to disconnect from the exhaust outlet stub pipe 20. Permanently attaching the exhaust stack pipe to the muffler is also not a solution since the exhaust stack pipe often needs to be removed for ready access to the engine compartment.

What is desired, then, is a vertically oriented exhaust stack system which is of simple construction, but which reduces stress concentrations and premature failure at the connection of the exhaust stack pipe and the muffler. Furthermore, the connection must provide a good exhaust seal and a strong mechanical support for the vertical orientated exhaust stack pipe on the vehicle. Also, the exhaust stack pipe should be both removable and replaceable for ready access to the engine compartment.

SUMMARY OF THE INVENTION

An exhaust stack system for a muffler has an exhaust outlet stub pipe including a first tapered portion on the outer diameter of the exhaust stub pipe. An exhaust stack pipe also has a second matching tapered portion on the inner diameter at the proximal end so as to matingly seat on the first tapered portion of the exhaust stub pipe. Preferably a securing mechanism holds the exhaust stack pipe in proper orientation with the muffler stub pipe.

In a preferred embodiment, the securing mechanism includes a spring clip member. The exhaust stack pipe has a longitudinal slot near the proximal end and the muffler stub pipe has a hole in alignment with the longitudinal slot. A hooked end of the spring clip is fitted through the longitudinal slot and into the hole. The hooked end of the spring clip can slid longitudinally in the longitudinal slot and allows the exhaust stack pipe to further longitudinally settle on the outlet stub pipe.

In other embodiments, the securing mechanism can be a threaded fastener screwed through a hole in the exhaust stack pipe and into the muffler stub pipe or alternatively a self-threading screw.

DETAILED DESCRIPTION OF THE PREFERRED EMBODIMENTS

As previously discussed, in many agricultural and construction vehicles, a horizontally or vertically orientated muffler is positioned along the top or side of the vehicle engine. For some vehicles, such as agricultural tractors and loader backhoes, the engine is located in the front of the vehicle. For other vehicles, such as skid steers and wheel loaders, the engine may be located in the rear of the vehicle.

Figure 2:
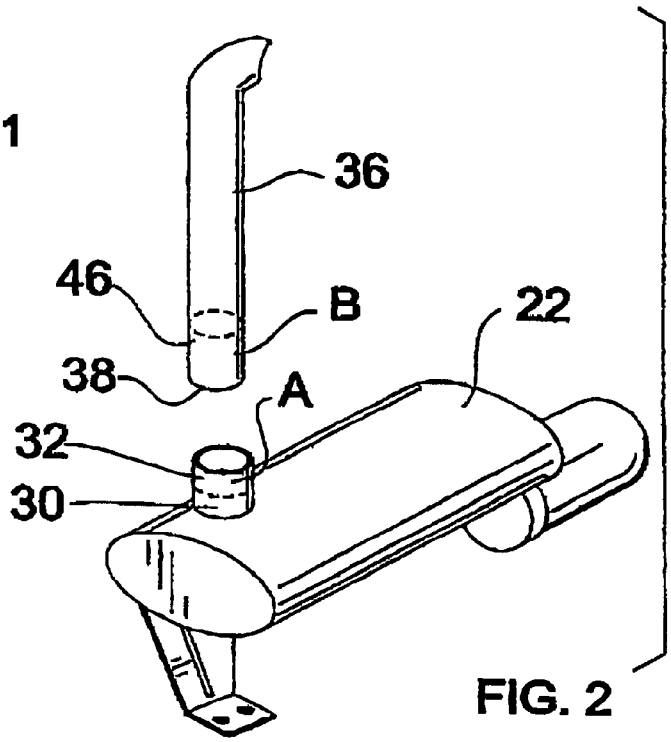
FIG. 2 shows a similar view of an exhaust stack system according to one embodiment of the present invention including a muffler outlet stub pipe and an exhaust stack pipe both having matching self-holding taper portions.
Figure 3:
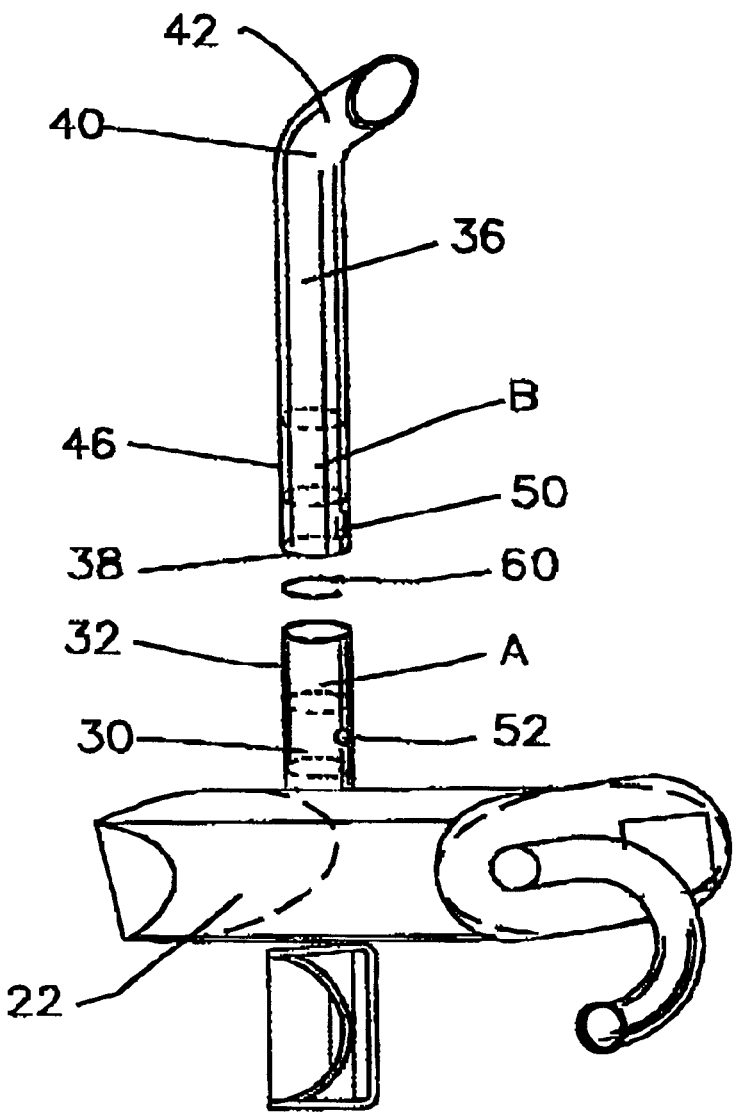
FIG. 3 shows an exploded view of the exhaust stack system of the present invention according to a preferred embodiment including the tapered muffler outlet stub pipe, the tapered exhaust stack pipe and a spring clip.
Figure 4:
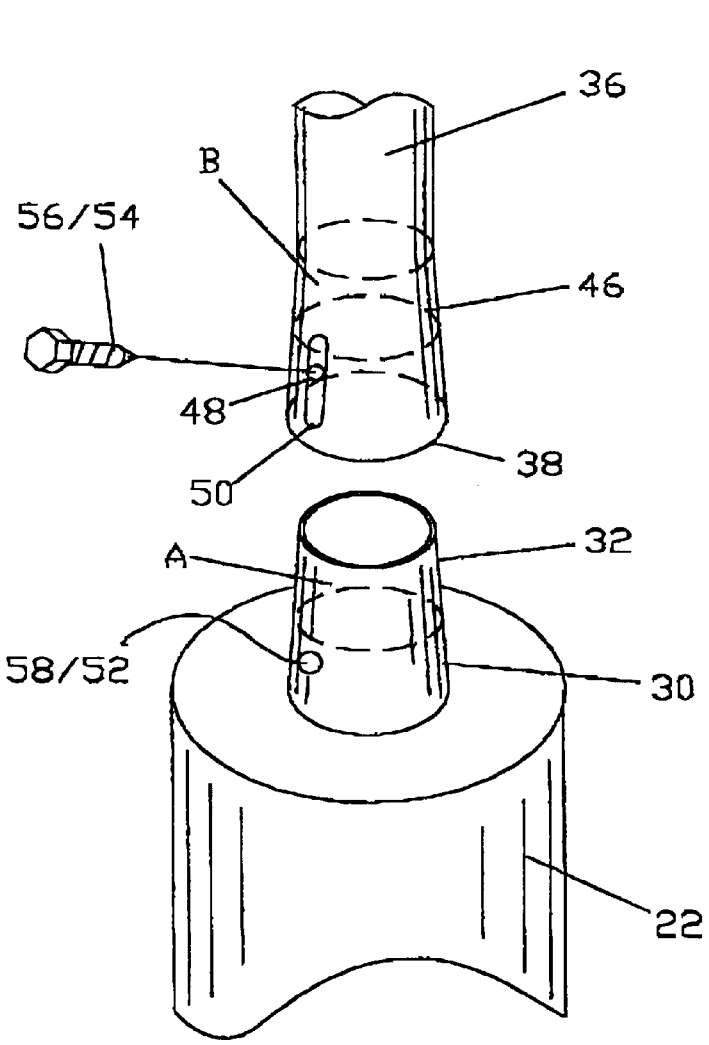
FIG. 4 shows an exploded view of the tapered exhaust stack pipe for seating on the tapered muffler stub pipe and securable by a threaded fastener.

Referring now to FIGS. 2–4, the exhaust stack system of the present invention will now be described. The horizontal or vertical orientated muffler 22 includes an integrally attached, vertically projecting, exhaust outlet stub pipe 30 that extends about 3 to 9 inches upward from the muffler. The exhaust outlet stub pipe 30 typically extends vertically from the muffler to a position near or through the hood of the engine compartment of the vehicle. The exhaust outlet stub pipe 30 of the present invention is manufactured with a tapered outer diameter portion 32 having a self-holding taper, designated A, near or approximate the end of the outlet stub pipe. The self-holding or Morse taper preferably has a profile of about 1 or 2 degrees of taper. Preferably the tapered portion 32 on the stub pipe 30 is longitudinally offset a suitable distance away from and above the body of the muffler 22, as shown in FIGS. 2 and 3.

The exhaust stack pipe 36 is made of a suitable material such as carbon steel and has a proximal end 38 and a distal end 40. The exhaust stack pipe has a predetermined length so that the exhaust fumes from the engine are discharged above the operator or cab of the vehicle. The distal end 40 of the exhaust stack pipe may have an integral or attached elbow 42 to further direct the exhaust fumes and to prevent foreign material from entering the exhaust stack pipe.

The proximal end 38 of the exhaust stack pipe has a tapered portion 46 on the inner diameter of the exhaust stack pipe 36. The taper on the inner diameter is also a self-holding taper or Morse taper, and is designated B. The self-holding taper B may also be offset a suitable distance away from and above the proximal end 38 of the exhaust stack pipe, as shown in FIG. 3. The self-holding taper B has the same taper profile as the self-holding taper A.

Thus the inner diameter tapered portion 46 of the exhaust stack pipe matches and fits securely onto the outer diameter tapered portion 32 of the muffler stub pipe. Since the tapered portion 32 of the exhaust stub pipe 30 is offset a suitable distance away from the body of the muffler as shown in FIGS. 2 and 3, when the tapered portion 46 of the exhaust stack pipe 36 is mated with the tapered portion 32 of the stub pipe 30, the proximal end 38 of the exhaust stack pipe 36 will be positioned offset from and above the muffler body. Thus the exhaust stack pipe 36 of the present invention preferably does not physically contact the muffler body 22.

Figure 1:
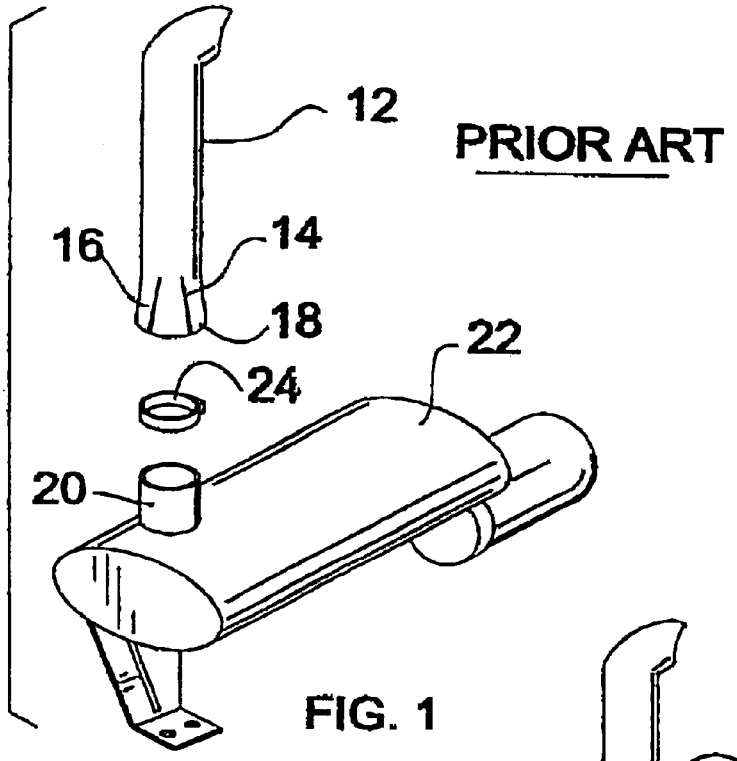
FIG. 1 shows a perspective view of a known exhaust stack system including a muffler, an exhaust stack pipe and a compression clamp.

The interface of the self-holding tapers A and B produces an area of contact along the mated tapered portions 32 and 46. The area of contact of the self-holding tapers A and B permits the exhaust stack pipe 36 to securely seat onto the muffler outlet stub pipe 30 and provide a sealed passageway for the exhaust. The large area of contact reduces the localized stress and premature failures in the presently used connection, shown in FIG. 1, wherein the muffler stub pipe is connected to the stack pipe by a tightened compression clamp which causes stress concentrations.

A sufficient portion of the self-holding taper A along the muffler outlet stub pipe 30 captures a sufficient portion of the self-holding taper B on the exhaust stack pipe 36 and compensates for any fit variation in the two pipes 30 and 36. The interface of self-holding tapered portions A and B also allows the exhaust stack pipe 36 to further settle and seat onto the outlet stub pipe 30 during subsequent operation after the initial assembly of the exhaust stack pipe 36.

Furthermore, according to the present invention, the exhaust stack pipe 36 can be reliably fixed for the proper orientation of the exhaust-directing elbow 42 relative to the vehicle operator. In one embodiment, as shown in FIG. 4, a hole 48 is drilled near the proximal end of the exhaust stack pipe 36. Alternatively, a longitudinal slot 50 is provided as described below. After the exhaust stack pipe 36 is securely seated on the outlet stub pipe 30, a second hole 52 is drilled through the first hole 48, or slot 50, and into the stub pipe. A fastener such as a threaded screw 54 can then be threaded through the hole 48 (or slot 50) and into the hole 52 to secure the exhaust stack pipe 36 to the stub pipe 30.

Alternatively, an optional fastener such as a self-drilling screw 56 can be screwed through the hole 48 (or slot 50) and into the exhaust stack pipe 36. The self-drilling screw 56 produces a self-drilled hole 58 in the outlet stub pipe 30. Thus the fasteners 54 or 56 can secure the exhaust stack pipe 36 to the stub pipe 30 and ensure that the elbow 42 is maintained in proper orientation on the distal end of the exhaust stack pipe 36 relative to the vehicle operator or cab.

In a preferred embodiment, as shown in FIG. 3, a spring clip 60 (or retaining ring) is used to secure the exhaust stack pipe 36 to the stub pipe 30 and to fix the directional orientation of the elbow 42. The spring clip 60 is used in conjunction with a longitudinal slot 50 in the exhaust stack pipe 36 and a hole 52 drilled in the stub pipe 30. The spring clip 60 and longitudinal slot 50 advantageously permits further longitudinal settling of the exhaust stack pipe 36 onto the muffler stub pipe 30.

Figure 5:
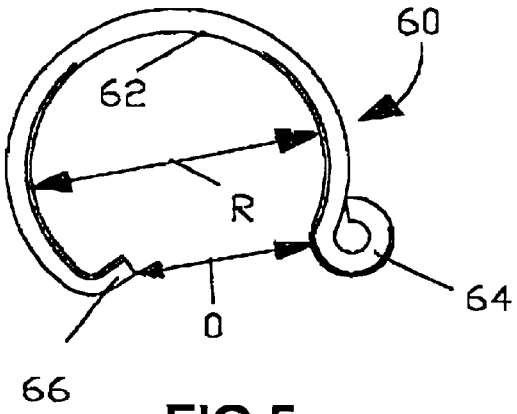
FIG. 5 shows a top view of the spring clip of FIG. 3.
Figure 6:
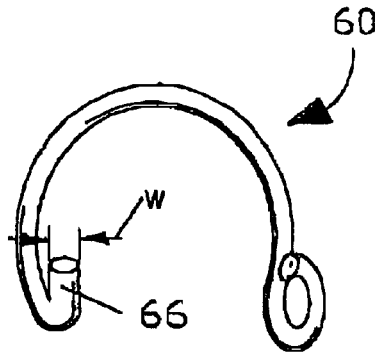
FIG. 6 shows a perspective view of the spring clip.

As shown in FIGS. 5 and 6, the spring clip 60 is constructed of spring steel wire. The steel wire has a wire diameter W and is formed into a partially open circular configuration. The spring clip 60 is constructed to have a partial circular portion 62 and an opening O. The circular portion 62 is greater than a semi-circle, and preferably is about 270 degrees, for example. The circular portion 62 also has a diameter dimension R that is equal to the outer diameter of the proximal end 38 of the exhaust stack pipe 36 so that the circular portion 62 of the spring clip fits snugly around the exhaust stack pipe 36. One end of the spring clip is bent outward, away from the circular portion, and preferably forms a handle-type loop 64, for example. The loop 64 provides a handle for positioning and manipulating the spring clip. The other end of the spring clip 60 is bent generally perpendicularly and radially inward, into the circular portion and forms a hooked end 66.

Preferably, as shown in FIG. 3, a longitudinal slot 50 is formed near the proximal end 38 of the exhaust stack pipe 36 prior to assembly. The slot 50 is preferably located between the tapered portion 46 and the proximal end 38 of the stack pipe 36. The slot 50 is approximately 1 inch long and approximately the width of the wire diameter W of the spring clip 60. During assembly, the self-holding tapered portion B of the exhaust stack pipe 36 is positioned over and seated on the self-holding tapered portion A of the outlet stub pipe 30. The exhaust stack pipe 36 and elbow 42 are properly orientated on the muffler stub pipe 30 so as to discharge exhaust away from the operator. A hole 52 is then drilled through the outlet stub pipe 30. The hole 52 is in alignment with the longitudinal slot 50 in the exhaust stack pipe 36, but is drilled near the bottom part of the aligned longitudinal slot. The hole 52 has the same diameter as the wire diameter W of the spring clip 60.

During assembly, the hooked end 66 of the spring clip 60 is inserted through the longitudinal slot 50 in the exhaust stack pipe 36 and into the drilled hole 52 in the outlet stub pipe 30. The hook 66 secures the exhaust stack pipe to the muffler stub pipe 30 and retains the stack pipe in the proper orientation with the muffler stub pipe 30. The opening 0 in the circular portion 62 of the spring clip 60 is then snapped over the exhaust stack pipe 36 and the spring clip is snugly positioned around the exhaust stack pipe. The exhaust stack pipe 36 will securely seat and seal on the stub pipe 30 due to the interface of the self-holding tapers A and B. The longitudinal slot 50 in the exhaust stack pipe permits the exhaust stack pipe 36 to move relative (longitudinally downward) to the spring clip 60 and stub pipe 30 so that the exhaust stack pipe 36 can further settle onto the muffler stub pipe 30 during subsequent operation of the vehicle. Also, the spring clip 60 can be easily removed to permit the exhaust stack pipe 36 to be both removed and replaced for access to the engine compartment.

The drawings and specific examples describe exemplary embodiments and serve the purpose of illustration only. The configurations shown and described may differ depending on the physical characteristics of the muffler and exhaust stack equipment. For example, the muffler may have a horizontal or vertical orientation. The exhaust stack pipe may be manufactured of an aluminized steel, rather than carbon steel, thus reducing rust. The fasteners may be threaded or self-drilling screws. The invention described is not limited to the precise details disclosed. Furthermore, other modifications and changes may be made in the design and arrangement of the exemplary embodiments without departing from the spirit of the invention as expressed in the appended claims.

What is claimed is:

1. In a work vehicle having an engine, a muffler for the engine and an exhaust stack system for the muffler, the exhaust stack system comprising:

a vertical exhaust outlet stub pipe on the muffler;

a first tapered portion on an outer diameter of the exhaust outlet stub pipe;

an exhaust stack pipe having a second tapered portion on an inner diameter of a proximal end of the exhaust stack pipe so as to matingly seat on the first tapered portion of the exhaust outlet stub pipe;

means for securing the exhaust stack pipe onto the muffler outlet stub pipe comprising a spring clip member having a hooked end for engagement with the exhaust outlet stub pipe and the exhaust stack pipe, the spring clip member including a generally circular spring wire member having a circumferential inner diameter equal to the outer diameter of the proximal end of the exhaust stack pipe; and the exhaust stack pipe has a longitudinal slot near the proximal end and the exhaust outlet stub pipe has a hole in alignment with the longitudinal slot so that the hooked end of the spring clip member can fit through the longitudinal slot and into the alignment hole.

2. An exhaust stack system for an engine muffler, the muffler having an exhaust outlet stub pipe having an outer diameter, the exhaust stack system comprising:

a first tapered portion on the outer diameter of the exhaust outlet stub pipe:

an exhaust stack pipe having a proximal end and a distal end, the proximal end having an outer diameter and an inner diameter, the inner diameter of the proximal end having a second tapered portion so that the second tapered portion matingly seats on the first tapered portion of the exhaust outlet stub pipe;

means for securing the second tapered portion on the first tapered portion comprising a spring clip member having a hooked end for engagement with the exhaust outlet stub pipe and the exhaust stack pipe, the spring clip member including a generally circular spring wire member having a circumferential inner diameter equal to the outer diameter of the proximal end of the exhaust stack pipe; and the exhaust stack pipe has a longitudinal slot near the proximal end and the exhaust outlet stub pipe has a hole in alignment with the longitudinal slot so that the hooked end of the spring clip member can fit through the longitudinal slot and into the aligned hole.

3. A method for securing a vertical exhaust stack pipe to an engine muffler having a vertically orientated exhaust outlet stub pipe, the method comprising:

providing a first tapered portion on an outer diameter of the exhaust outlet stub pipe;

providing an exhaust stack pipe having a second tapered portion on an inner diameter of a proximal end of the exhaust stack pipe;

seating the second tapered portion of the exhaust stack pipe over the first tapered portion of the exhaust outlet stub pipe;

providing a longitudinal slot near the second tapered portion in the exhaust stack pipe;

orienting the exhaust stack pipe relative to the exhaust outlet stub pipe;

providing a hole near the first tapered portion in the exhaust outlet stub pipe in alignment with the longitudinal slot; and providing a securing means to secure the exhaust stack pipe to the exhaust outlet stub pipe by engagement through the longitudinal slot and the hole, the securing means including a generally circular spring clip having an open portion for engaging around the exhaust stack pipe and a hooked end for engaging in the slot in the exhaust stack pipe and through the hole in the exhaust outlet stub pipe.

* * * * *